US011925248B2

(12) United States Patent
Waki

(10) Patent No.: US 11,925,248 B2
(45) Date of Patent: Mar. 12, 2024

(54) LIQUID COSMETIC MATERIAL CONTAINER

(71) Applicant: TOKIWA CORPORATION, Nakatsugawa (JP)

(72) Inventor: Takao Waki, Kawaguchi (JP)

(73) Assignee: TOKIWA CORPORATION, Nakatsugawa (JP)

( * ) Notice: Subject to any disclaimer, the term of this patent is extended or adjusted under 35 U.S.C. 154(b) by 111 days.

(21) Appl. No.: 17/573,370

(22) Filed: Jan. 11, 2022

(65) Prior Publication Data

US 2022/0218090 A1 Jul. 14, 2022

(30) Foreign Application Priority Data

Jan. 12, 2021 (JP) ..... 2021-003042

(51) Int. Cl.

*A45D 34/04* (2006.01)
*A46B 9/02* (2006.01)
*A46B 11/00* (2006.01)

(52) U.S. Cl.

CPC ..... *A45D 34/043* (2013.01); *A46B 9/021* (2013.01); *A46B 9/026* (2013.01); *A46B 11/001* (2013.01); *A46B 11/0089* (2013.01); *A45D 2200/054* (2013.01); *A45D 2200/1072* (2013.01); *A46B 2200/1046* (2013.01)

(58) Field of Classification Search

CPC ..... A45D 34/042; A45D 2200/1072; A46B 2200/1046; B43K 1/12; B43K 8/022

See application file for complete search history.

(56) References Cited

U.S. PATENT DOCUMENTS 6,010,266 A 1/2000 Schrepf
11,084,316 B2 * 8/2021 Maruyama ..... A45D 34/042
11,766,110 B2 * 9/2023 Nakada ..... B43K 8/003 401/68
2005/0249542 A1 11/2005 Hori
2007/0172307 A1 * 7/2007 Jo ..... A46B 11/0065 401/278

(Continued)

FOREIGN PATENT DOCUMENTS

CN 107074004 A 8/2017
CN 110650650 A 1/2020
CN 211833260 U 11/2020

(Continued)

*Primary Examiner* — David P Angwin
*Assistant Examiner* — Bradley S Oliver
(74) *Attorney, Agent, or Firm* — Procopio, Cory, Hargreaves & Savitch LLP

(57) ABSTRACT

A liquid cosmetic material container includes a sleeve that includes a storage chamber that stores a liquid cosmetic material therein, a bead member that is disposed at a front end of the sleeve, has a through hole extending in an axial direction of the liquid cosmetic material container and configured to store a brush in the through hole, a relay core that is configured to connect the brush and the storage chamber, enter the brush, and send the liquid cosmetic material in the storage chamber to the brush, and a cap that is detachably attached to the sleeve. A rear portion of the through hole has a first cross sectional area, and a front portion of the through hole has a second cross sectional area which is smaller than the first cross sectional area.

11 Claims, 12 Drawing Sheets

(56) References Cited

U.S. PATENT DOCUMENTS

| | | | | |
|---|---|---|---|---|
| 2009/0010702 | A1* | 1/2009 | Nehashi | A46B 11/0013 401/24 |
| 2020/0269629 | A1* | 8/2020 | Shih | B43K 3/00 |

FOREIGN PATENT DOCUMENTS

| | | | | | |
|---|---|---|---|---|---|
| JP | S63-005910 | A | | 1/1988 | |
| JP | 2002165637 | A | * | 6/2002 | A45D 34/042 |
| JP | UM-3168986 | U | | 7/2011 | |
| JP | 2017-038787 | A | | 2/2017 | |
| JP | 6425293 | B1 | | 8/2019 | |
| KR | 2009-0027340 | A | | 3/2009 | |
| KR | 200463527 | Y1 | | 11/2012 | |
| WO | 2017-026176 | A1 | | 2/2017 | |

* cited by examiner

LIQUID COSMETIC MATERIAL CONTAINER

CROSS REFERENCE TO RELATED APPLICATIONS

This application is based on Japanese Patent Applications No. 2021-003042 filed on Jan. 12, 2021, the entire contents of which are incorporated herein by reference.

TECHNICAL FIELD

The present disclosure relates to a liquid cosmetic material container for applying a liquid cosmetic material accommodated therein.

BACKGROUND ART

In the related art, containers using a brush have been sold in various markets as application tools for applying a liquid cosmetic material accommodated therein. It is known that these containers have a structure in which a gap is provided between the brush for applying the liquid cosmetic material inside the container and a member such as a bead member for bundling the brush to circulate air in the container. By providing the gap for air circulation, the liquid cosmetic material in the container can be spread to the brush.

Japanese Patent No. 6425293 discloses that a plurality of air circulation grooves are provided in an inner peripheral surface of a holding portion between a rod-shaped core material and the holding portion that holds the rod-shaped core material, an inside and an outside of a container are communicated with each other to circulate air, so that a flow of a liquid application material that has permeated into the rod-shaped core material is made smooth, and blurring and lack of liquid at a pen tip are prevented.

JP-UM-A-63-5910 discloses that a brush portion is held in a cylindrical body, a plurality of wedge-shaped protrusions are provided on a circumference of a front end portion of an inner peripheral wall of the cylindrical body, and these protrusions are inserted into the brush portion so as to form deep split grooves (air circulation grooves) that divide the brush portion, and a liquid eyeliner passes through the split grooves and is spread to the entire brush portion.

However, in U.S. Pat. No. 6,425,293, there is a problem that a part of the brush enters the plurality of air circulation grooves provided in the holding portion, and a front end of the brush is loosened, thereby causing hindrance to application.

Further, in JP-UM-A-63-5910, there is a problem that when drawing is performed by moving the brush portion, the bristles on the brush portion is caught by the protrusions to make it difficult to perform the writing, and the application is also hindered.

Therefore, an object of the present invention is to provide a liquid cosmetic material container that is easy to draw by a brush and that can efficiently supply a liquid cosmetic material to the brush.

SUMMARY OF INVENTION

According to an aspect of the disclosure, a liquid cosmetic material container includes a sleeve that includes a storage chamber that stores a liquid cosmetic material therein, a bead member that is disposed at a front end of the sleeve, has a through hole extending in an axial direction of the liquid cosmetic material container and configured to store a brush in the through hole, a relay core that is configured to connect the brush and the storage chamber, enter the brush, and send the liquid cosmetic material in the storage chamber to the brush, and a cap that is detachably attached to the sleeve. In the liquid cosmetic material container, a rear portion of the through hole has a first cross sectional area, a front portion of the through hole has a second cross sectional area which is smaller than the first cross sectional area, and a cross sectional area of the through hole is gradually changed from the first cross sectional area to the second cross sectional area. When viewed in the axial direction, a shape of the rear portion of the through hole is formed in a first corrugated shape in which first concave and first convex portions are alternately disposed and connected to have a first annular shape, the brush comes into contact with the first convex portions of the first corrugated shape, and a first gap is formed between each of the first concave portions of the first corrugated shape and the brush. When viewed in the axial direction, a shape of the front portion of the through hole is formed in a second corrugated shape in which second concave and second convex portions are alternately disposed and connected to have a second annular shape, the brush comes into contact with the second convex portions of the second corrugated shape, and a second gap which is smaller than the first gap is formed between each of the second concave portions of the second corrugated shape and the brush. A concave curvature of one of the second concave portions is smaller than that of a corresponding one of the first concave portions, and a convex curvature of one of the second convex portions is smaller than that of a corresponding one of the second convex portions.

According to such a liquid cosmetic material container, the bead member in which the brush is stored is provided with the through hole whose hole shape is narrowed from the rear portion to the front portion. The shape of the rear portion of the through hole of the bead member as viewed in the axial direction is formed in a corrugated shape in which concave and convex portions are alternately continuous and connected in an annular shape. For this reason, when the brush has a general shape in which a cross section thereof is a perfect circle and is tapered toward the front end, the brush comes into contact with the convex portion of the corrugated shape and is suitably tightened, and the brush is pressed by the convex portion of the corrugated shape and moves to the concave portions on both sides of the convex portion so as to be continuously arranged, and a relatively large gap is formed between the arranged brush and the concave portion. This gap is regarded as a liquid cosmetic material accumulation portion capable of sufficiently storing the liquid cosmetic material by a capillary force, and extends forward. As for the shape of the front portion of the through hole of the bead member as viewed in the axial direction, since the portion thereof corresponding to the convex portion of the corrugated shape is a line having a curvature smaller than the curvature of the convex portion of the corrugated shape and is in contact with the brush, the brush is appropriately pressed. Since the portion corresponding to the concave portion of the corrugated shape is rounded at a portion R having a curvature smaller than the curvature of the concave portion of the corrugated shape, a minute gap smaller than the above gap is formed between the portion R and the brush. The minute gap is an allowable space where the brush is movable, so that the brush is appropriately and easily moved, and the portion R prevents the bristles on the brush from getting caught. That is, at the time of drawing, the brush can be moved in the minute gap while being appropriately pressed by a line having a curvature smaller than the curvature of the convex portion of the corrugated shape at the front portion of the through hole of the bead member, a variation of the front end of the brush generated when the brush is pressed without a gap, a disturbance due to excessive blurring of the brush generated when the gap is excessively large, and the catching of the brush by protrusions or the like are prevented, so that favorable drawing can be performed. Further, since the minute gap between the bead member and the brush and the gap as the liquid cosmetic material accumulation portion are communicated with each other to form an air circulation gap, the liquid cosmetic material in the liquid cosmetic material accumulation portion can be efficiently supplied to the brush.

Here, as a configuration that effectively achieves the above action, specifically, a line having a curvature smaller than the curvature of the convex portion of the corrugated shape is a straight line having a curvature of 0, and the shape of the front portion of the through hole of the bead member as viewed in the axial direction is exemplified as a shape in which a corner of a polygon having straight lines as sides is rounded at the portion R. According to such a configuration, since the brush is in contact with the sides of the polygon, the brush can be more suitably pressed.

Further, a brush holding portion that holds the brush and has a diameter larger than that of a base end portion of the brush is provided in the base end portion of the brush, the relay core penetrates the brush holding portion, a rear end surface of the bead member that stores the brush faces a front end surface of the brush holding portion, the front end surface of the brush holding portion undulates so as to be uneven in the axial direction, so that a gap that is continuous in the circumferential direction is formed between the rear end surface of the facing bead member and the undulating front end surface of the brush holding portion, a degree of communication between an outside and the liquid cosmetic material accumulation portion is further increased by the gap, and the liquid cosmetic material can be more efficiently supplied to the brush.

Further, when the relay core is formed of a plastic material having a cavity penetrating in the axial direction, the liquid cosmetic material using a material having a large particle diameter such as a pearl agent or a liquid cosmetic material having high viscosity can be suitably supplied to the brush through the cavity by the capillary force.

Further, an opening at the front end of the relay core is preferably located inward of the portion R having the curvature smaller than the curvature of the concave portion of the corrugated shape in the front portion of the through hole of the bead member. When such a configuration is adopted, the brush moves (flutters) in the minute gap and hits the opening at the front end of the relay core formed of a plastic material at the time of drawing. Thereby, a contact range of the brush with the opening at the front end of the relay core is expanded, an outflow of the liquid cosmetic material from the opening at the front end of the relay core is promoted, the liquid cosmetic material is easily transmitted to the brush, and beautiful drawing can be performed.

According to the present disclosure, the liquid cosmetic material container that is easy to draw by a brush and capable of efficiently supplying the liquid cosmetic material to the brush is provided.

DETAILED DESCRIPTION OF EMBODIMENTS

Figure 1:
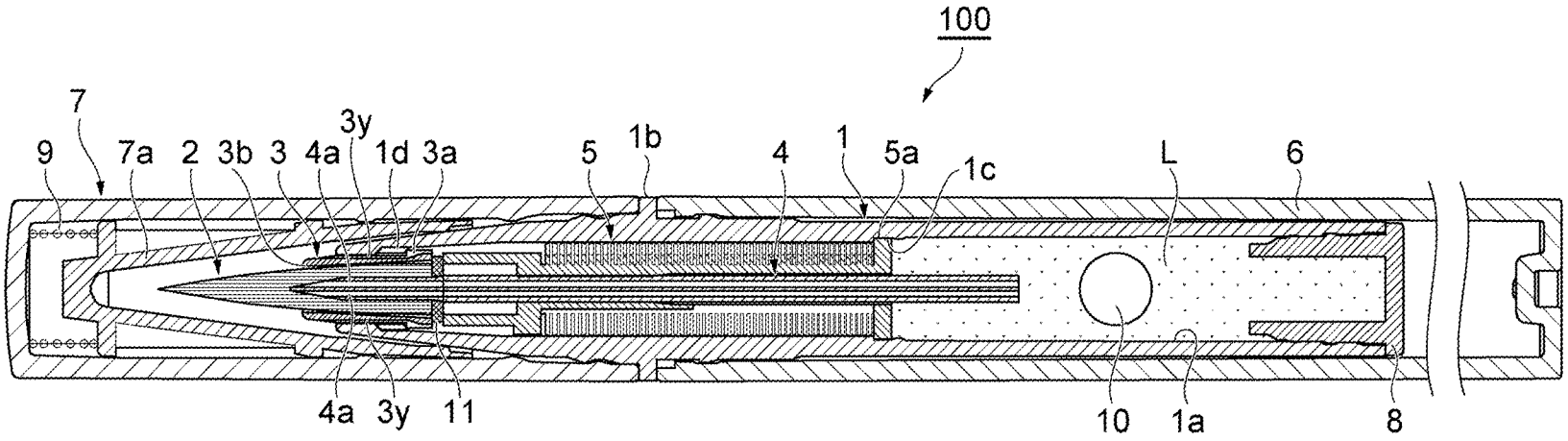
FIG. 1 is a vertical cross-sectional view illustrating a liquid cosmetic material container according to an embodiment of the present disclosure.
Figure 2:
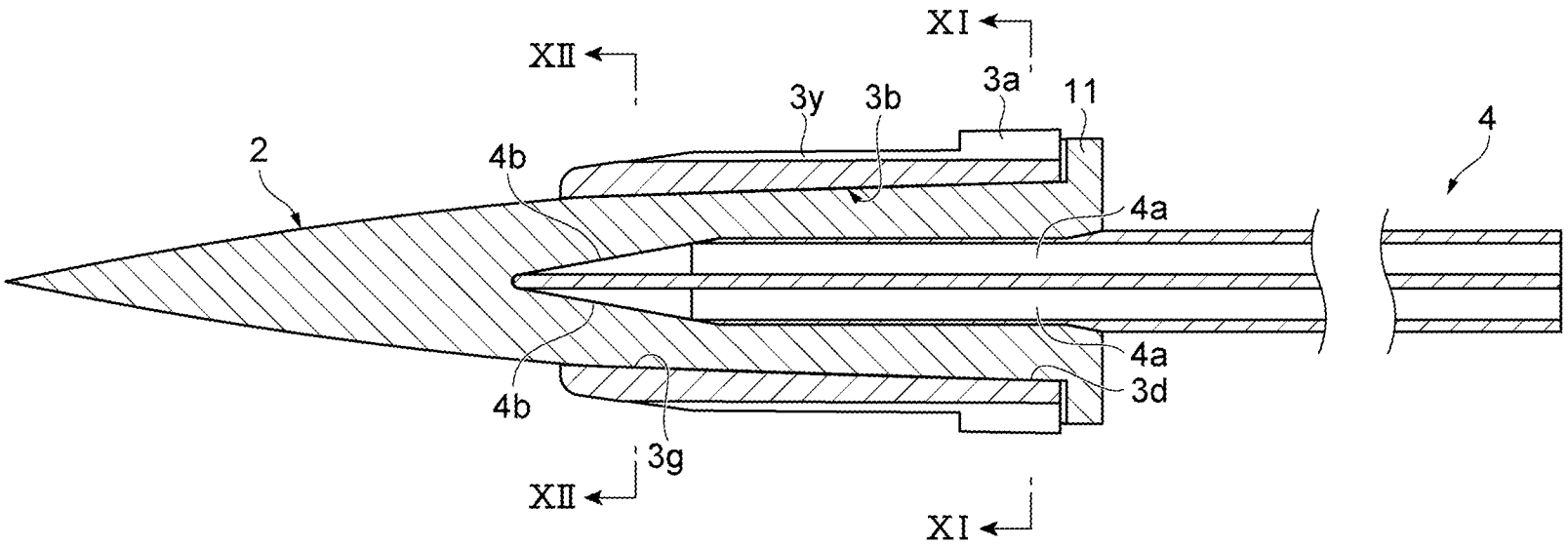
FIG. 2 is a vertical cross-sectional view illustrating a brush, a brush holding portion, a bead member, and a relay core in FIG. 1.
Figure 3:
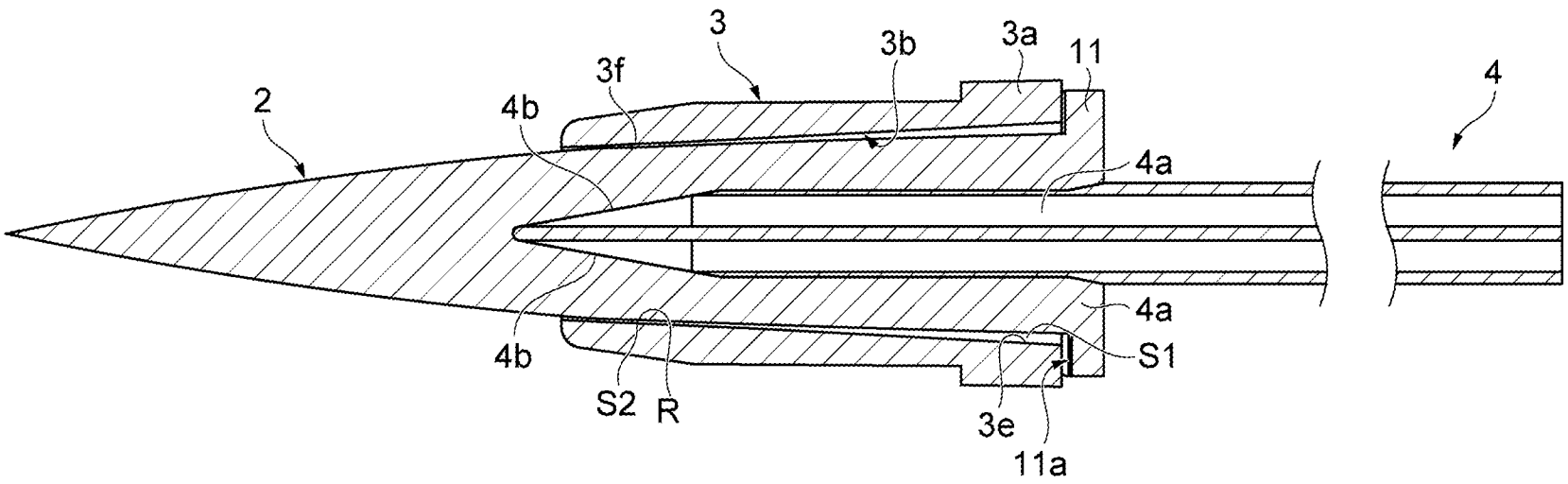
FIG. 3 is a cross-sectional view of FIG. 2 at a position rotated by 22.5° in a circumferential direction.
Figure 4:
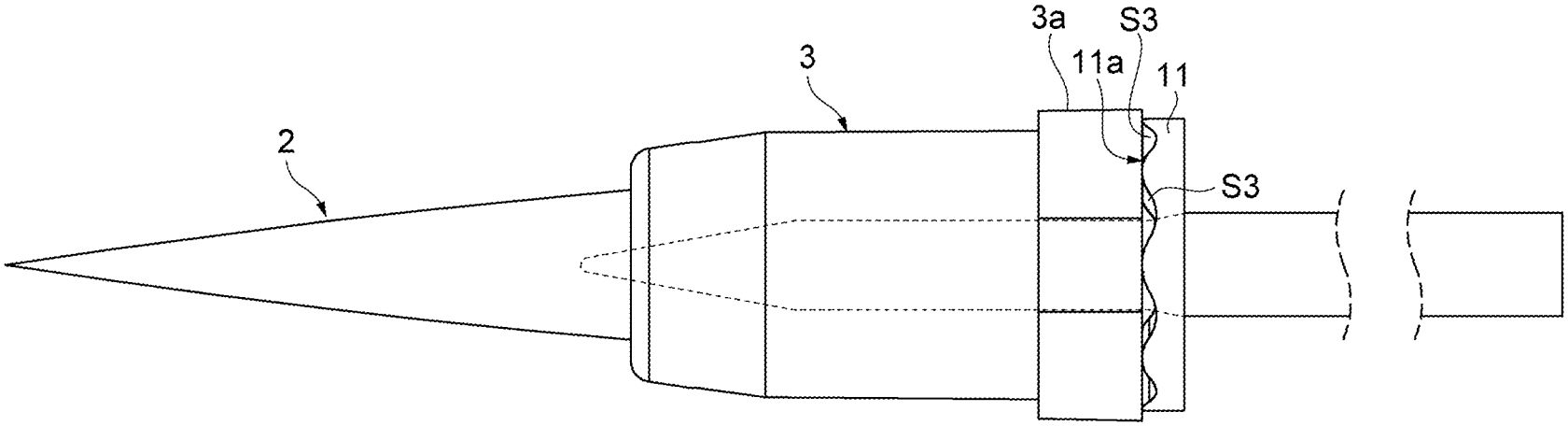
FIG. 4 is a side view illustrating the brush, the brush holding portion, the bead member, and the relay core in FIG. 1.
Figure 9:
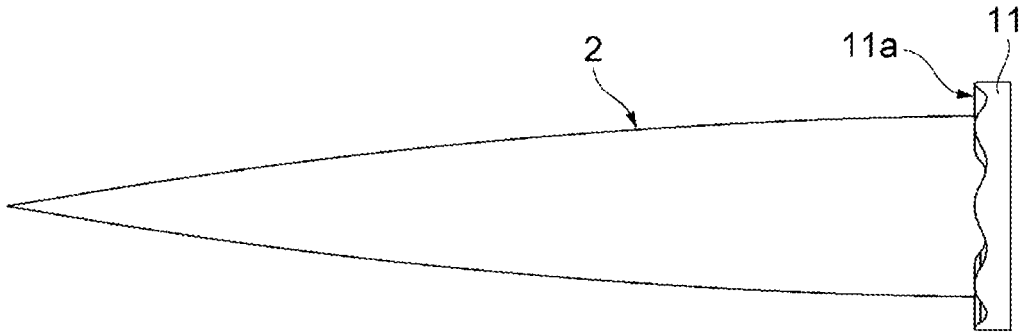
FIG. 9 is a side view illustrating the brush and the brush holding portion in FIG. 1.
Figure 10:
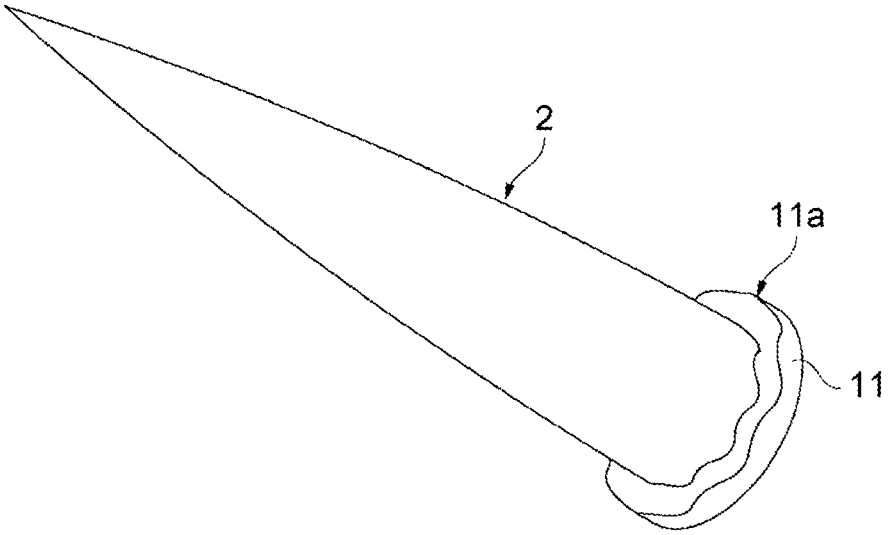
FIG. 10 is perspective view of the brush and the brush holding portion illustrated in FIG. 9.
Figure 11:
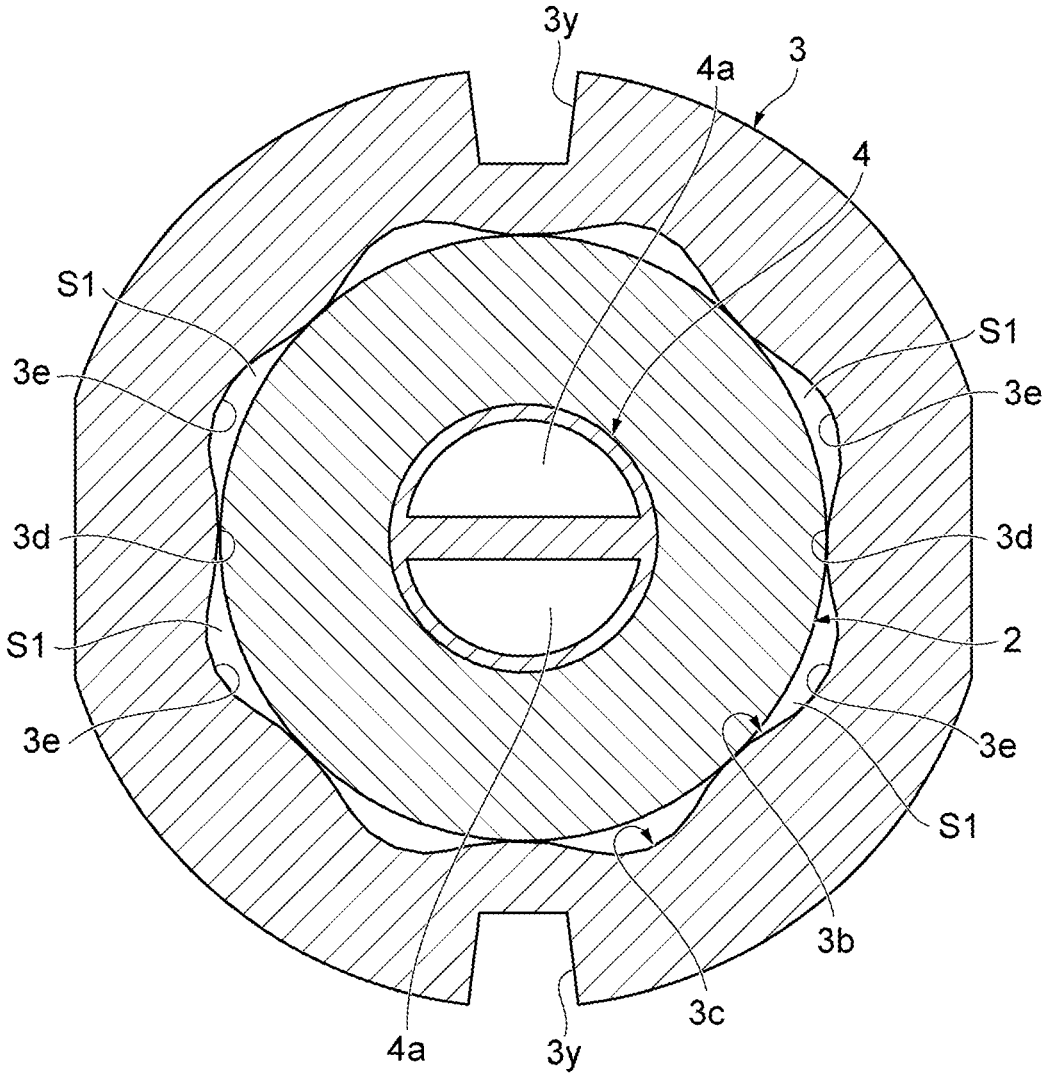
FIG. 11 is a cross-sectional view taken along a line XI-XI in FIG. 2.
Figure 12:
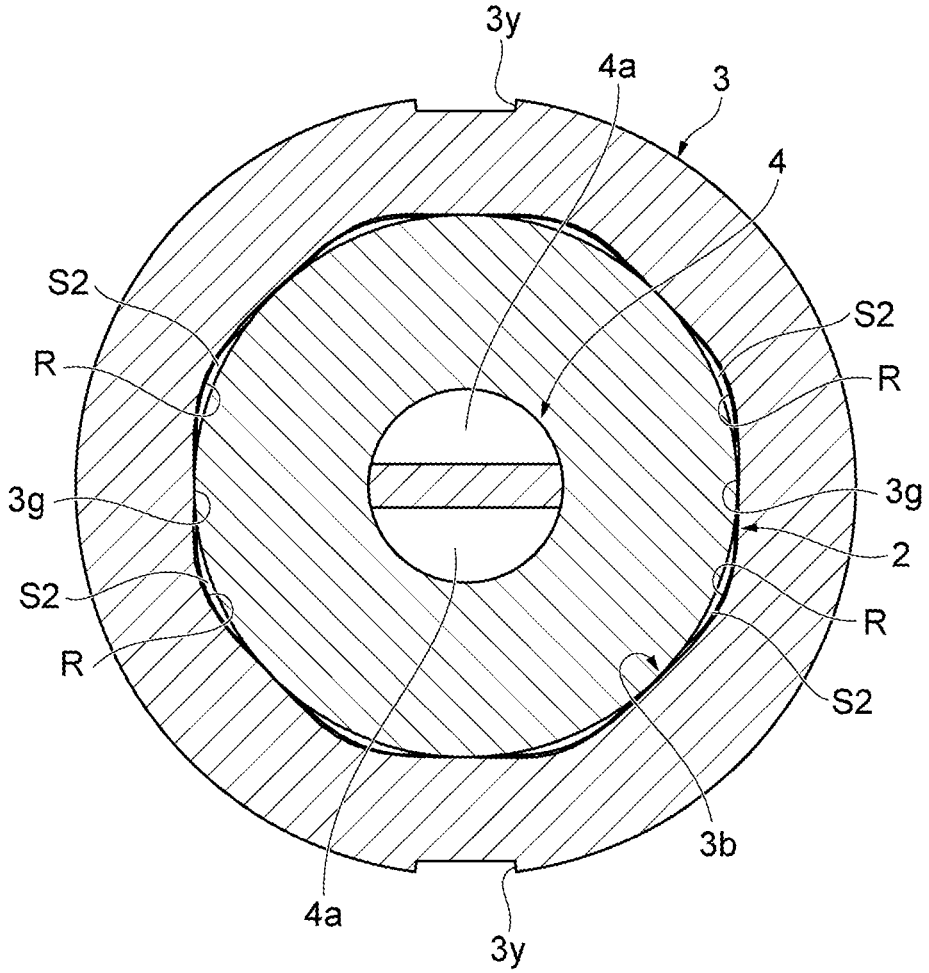
FIG. 12 is a cross-sectional view taken along a line XII-XII in FIG. 2.

Hereinafter, a preferred embodiment of a liquid cosmetic material container according to the present disclosure will be described with reference to FIGS. 1 to 12. FIG. 1 is a vertical cross-sectional view illustrating the liquid cosmetic material container according to the embodiment of the present disclosure; FIGS. 2 to 4 are views illustrating a brush, a brush holding portion, a bead member, and a relay core; FIGS. 5 to 8 are views illustrating the bead member; FIGS. 9 and 10 are views illustrating the brush and the brush holding portion; FIG. 11 is a cross-sectional view taken along a line XI-XI in FIG. 2; and FIG. 12 is a cross-sectional view taken along a line XII-XII in FIG. 2. The liquid cosmetic material container of the present embodiment is used when a liquid cosmetic material is applied to a skin or the like that is a portion to be coated, and is particularly suitable for drawing a thin line on an eyelid such as an eyeliner or drawing a thin line on eyebrows such as an eyebrow pen. The liquid cosmetic material is not limited to the eyeliner and the eyebrow pen, and may be other liquid cosmetic materials.

As illustrated in FIG. 1, a liquid cosmetic material container 100 has an elongated round bar shape such as a writing instrument as a whole, and schematically includes a sleeve 1 that has a cylindrical shape and includes a storage chamber 1*a* for storing a liquid cosmetic material L therein, a brush 2 that is disposed on a front end side of the sleeve 1 and is for applying the liquid cosmetic material L to a portion to be coated, a cylindrical bead member (brush holder) 3 that is provided on a front end of the sleeve 1 and stores the brush 2 therein, a shaft-shaped relay core 4 that is disposed in the sleeve 1 and connects the storage chamber 1*a* and the brush 2, and a substantially cylindrical bellows member 5 that is disposed so as to surround the relay core 4. Here, in order for a user to easily hold and apply the sleeve 1, an elongated grip tube 6 having a bottomed cylindrical shape is detachably attached to the sleeve 1.

The sleeve 1 is made of, for example, polypropylene (PP) or the like, and is formed in a tapered cylindrical shape with a flange. A front end surface of the grip tube 6 abuts against a rear end surface of a flange portion 1*b* provided on an outer peripheral surface of the sleeve 1, and an open end surface of a cap 7 attached to the sleeve 1 abuts against a front end surface of the flange portion 1*b*. An opening at a rear end of the sleeve 1 is closed by inserting and mounting a bottomed cylindrical tail plug 8.

The bottomed cylindrical cap 7 for protecting the brush 2 or the like is detachably attached to a front side of the sleeve 1 by fitting. An inner cap 7*a* that is biased toward the sleeve 1 by a coil spring 9 is provided in the cap 7. The cap 7 and the inner cap 7*a* are made of, for example, PP or the like, and when the cap 7 is attached, the inner cap 7*a* is brought into close contact with a tapered outer peripheral surface of the front end side of the sleeve 1 by a biasing force of the coil spring 9 to ensure airtightness and suppress volatilization of a liquid cosmetic material component.

The bellows member 5 is for adjusting a liquid amount of the liquid cosmetic material L, and is made of, for example, PP or the like. The bellows member 5 has a groove (bellows) containing the liquid cosmetic material L, and is attached to the sleeve 1 by fitting a cylindrical rear end portion 5*a* of the bellows member 5 into a concave portion 1*c* in an inner peripheral surface of the sleeve 1. The storage chamber 1*a* is formed between the rear end portion 5*a* of the bellows member 5 and the tail plug 8 in the sleeve 1, and the liquid cosmetic material L is filled in the storage chamber 1*a*. A stirring ball 10 for stirring the liquid cosmetic material L is accommodated in the storage chamber 1*a*.

Here, the relay core 4 is formed of a plastic material. The relay core 4 is formed in an elongated cylindrical body, and is formed in a sharp conical shape that is gradually tapered toward a front end side at a front end portion. The elongated cylindrical portion of the relay core 4 extends in an axial direction so as to pass through a cylindrical hole of the bellows member 5, and an intermediate portion of the relay core 4 in the axial direction is fitted to a portion of the bellows member 5 on a front side of the groove, and thus the relay core 4 is attached to the bellows member 5.

As illustrated in FIGS. 2, 3, 11, and 12, a plurality of cavities 4*a* penetrating in the axial direction are formed inside the relay core 4, and here, two cavities are formed so as to face each other. As illustrated in FIG. 1, a rear end portion of the relay core 4 enters the storage chamber 1*a* and is immersed in the liquid cosmetic material L, and the front end portion of the relay core 4 enters the brush 2 and comes into contact with the brush 2 to connect the storage chamber 1*a* and the brush 2.

The cavity 4*a* exhibits a capillary phenomenon with respect to the liquid cosmetic material L in the storage chamber 1*a*, and feeds the liquid cosmetic material L to the front end of the relay core 4. As illustrated in FIGS. 2 and 3, the front end portion of the relay core 4 that entered the brush 2 has a sharp conical shape. Therefore, an opening 4*b* at the front end of the cavity 4*a* is elongated in the axial direction as an inclined substantially elliptical (substantially oval) shape, and is in a state of being in contact with the brush 2.

The brush 2 is made of for example, polybutylene terephthalate (PBT) or the like, is formed by bundling a large amount of bristles (fibers), and is formed in a substantially perfect circle in a cross section thereof. As illustrated in FIGS. 9 and 10, the brush 2 has a general substantially conical shape that is gradually tapered toward the front end and has a sharp front end. A brush holding portion 11 that holds the brush 2 by welding and has a diameter larger than that of a base end portion of the brush 2 is provided at the base end portion (rear end portion) of the brush 2. The brush holding portion 11 is formed in a substantially disk shape, and a through hole (see FIGS. 2 and 3) through which the relay core 4 passes is formed in a center of the brush holding portion 11. A front end surface 11*a* of the brush holding portion 11 undulates along a circumferential direction so as to be uneven shape in the axial direction. The uneven shape of the front end surface 11*a* of the brush holding portion 11 may be a wave shape including at least one of a sine wave shape, a triangle wave shape, a rectangle wave shape or a sawtooth wave shape.

The bead member 3 is made of, for example, PP or the like, and is formed in a substantially cylindrical shape as illustrated in FIGS. 5 to 8. The bead member 3 has a step portion 3*a* that is slightly tapered at a front end portion and is enlarged in diameter at a rear end portion. A groove 3*y* that is open rearward, extends forward, and is open forward from the tapered front end is provided at a position facing an outer peripheral surface of the bead member 3.

Further, the bead member 3 includes a through hole (cylindrical hole) 3*b* that penetrates in the axial direction and whose hole shape is continuously narrowed from a rear end to a front end so as to store the brush 2.

Figure 7:
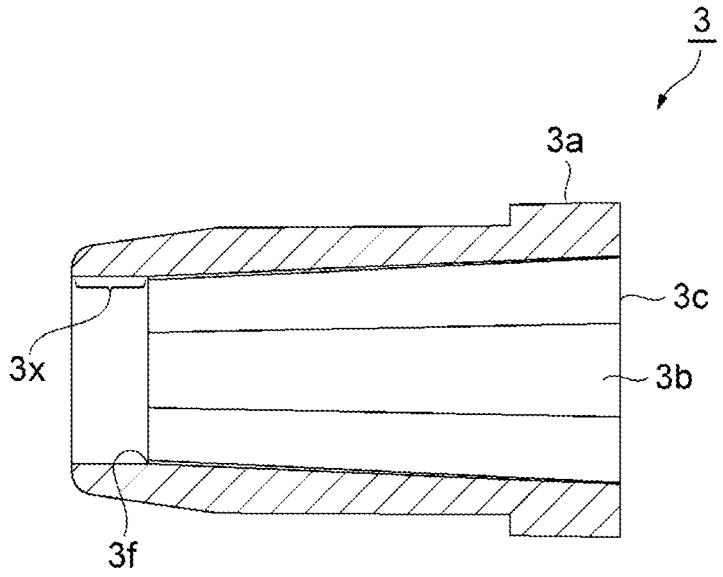
FIG. 7 is a cross-sectional view taken along a line VII-VII in FIG. 5.
Figure 8:
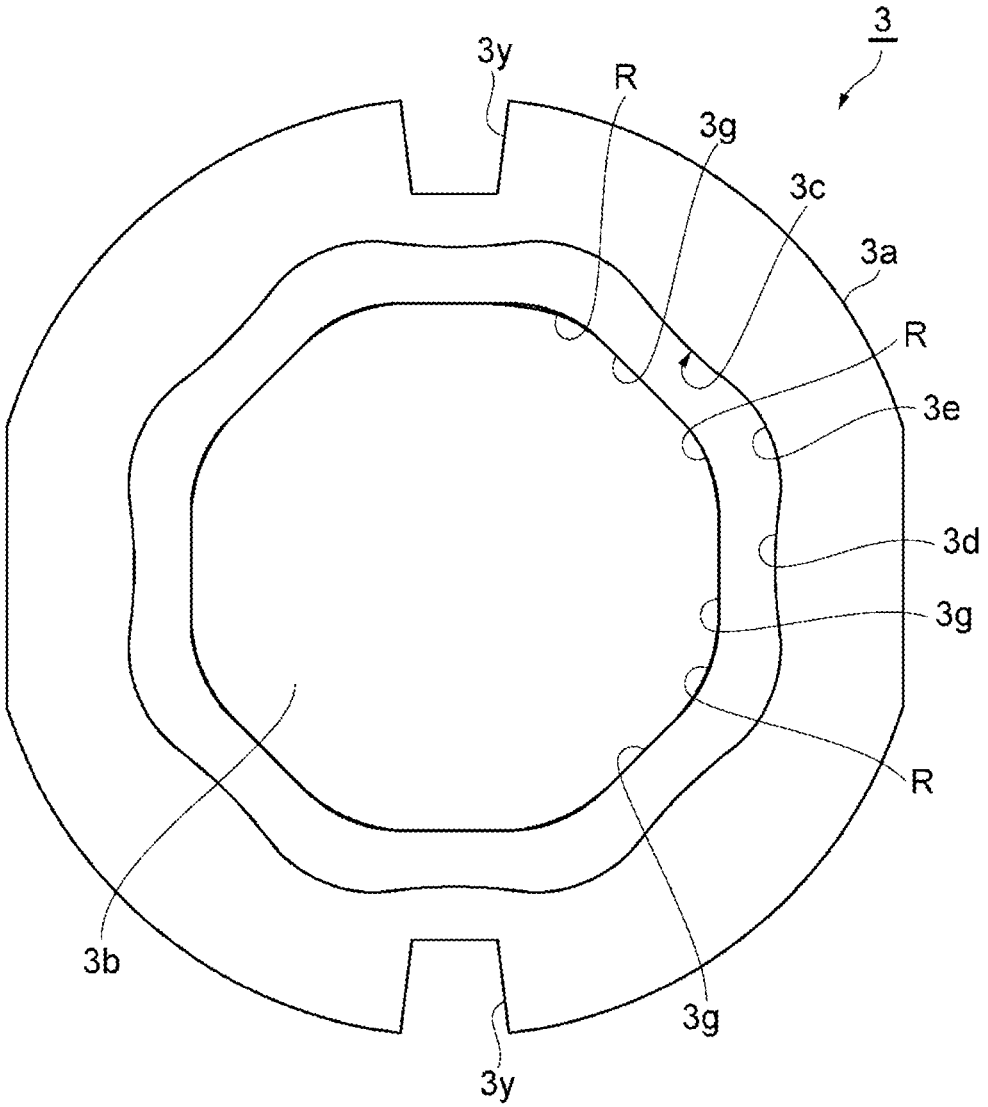
FIG. 8 is a back view illustrating the bead member in FIG. 1.

As illustrated in FIG. 8, a shape of a rear portion (rear end edge) of the through hole 3*b* of the bead member 3 as viewed in the axial direction is formed in a corrugated shape 3*c* in which concave and convex portions are alternately continuous and connected in an annular shape. Here, a curvature of a concave portion 3*e* is slightly larger than a curvature of a convex portion 3*d*. As illustrated in FIGS. 7 and 8, the through hole 3*b* is gradually reduced in diameter toward the front end thereof, so that the concave and convex portions of the corrugated shape 3*c* at the rear portion of the through hole 3*b* become smooth, and the through hole 3*b* is formed in the same shape from the front end to a predetermined distance rearward position 3*f*.

Figure 5:
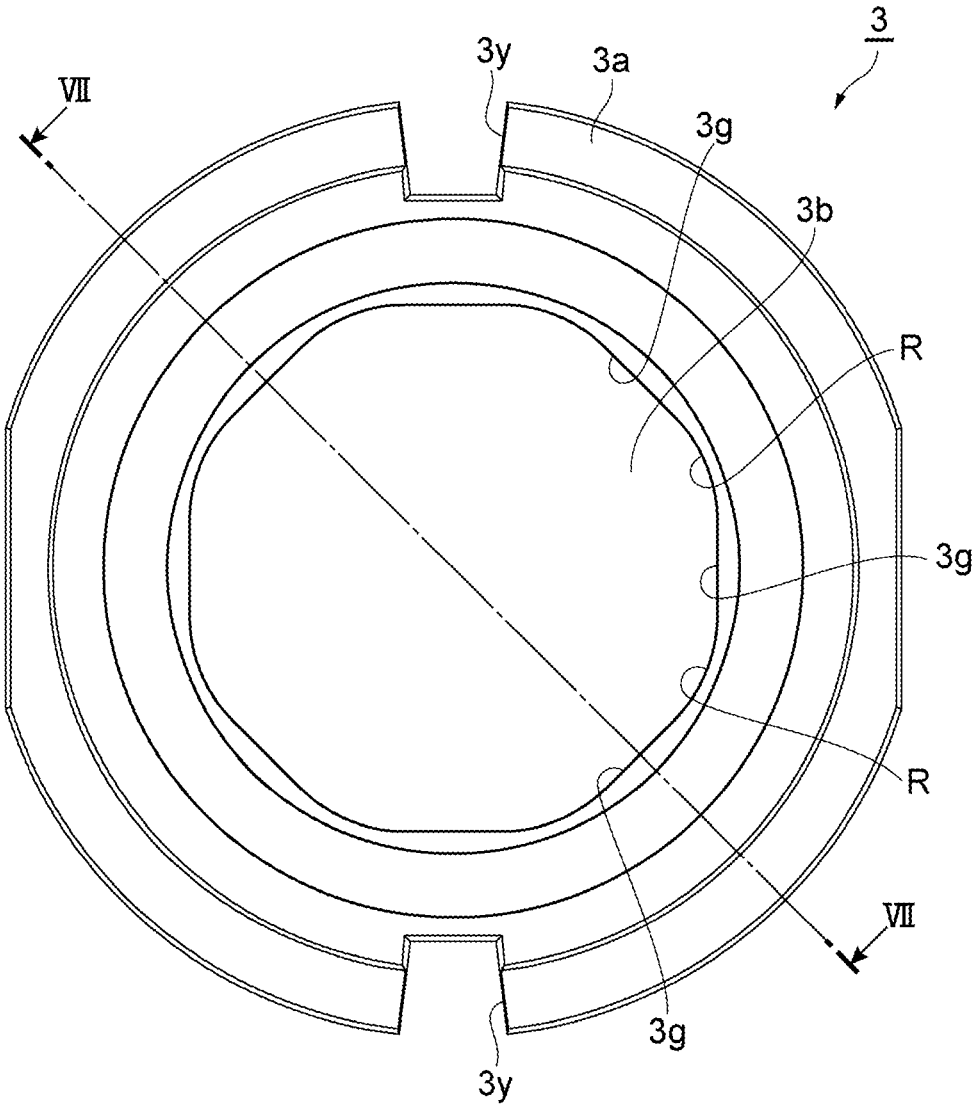
FIG. 5 is a front view illustrating the bead member in FIG. 1.

As for a shape of the bead member 3 from the front end of the through hole 3*b* to the predetermined distance rearward position 3*f*, that is, a shape of a front portion 3*x* of the through hole 3*b* of the bead member 3 as viewed in the axial direction, as illustrated in FIGS. 5 and 8, a portion corresponding to the convex portion 3*d* of the corrugated shape 3*c* at the rear end is a line having a curvature smaller than the curvature of the convex portion 3*d* of the corrugated shape 3*c*, and here, in particular, is a straight line 3*g* having a curvature of 0. A portion at the front portion 3*x* of the through hole 3*b* of the bead member 3 corresponding to the concave portion 3*e* of the corrugated shape 3*c* is rounded at a portion R that has a curvature smaller than the curvature of the concave portion 3*e*. That is, here, corners of an octagon having sides 3*g* that are straight lines are each rounded.

As illustrated in FIG. 1, the front end portion of the bead member 3 protrudes forward from the sleeve 1, a portion of the bead member 3 on a rear side of the front end portion enters a front end portion of the sleeve 1, and the step portion 3*a* of the bead member 3 protrudes inward at a front end portion of the sleeve 1, is located on a rear side of a plurality of (here, four) protruding portions 1*d* provided along the circumferential direction, and faces the protruding portions 1*d*.

When the bellows member 5 is attached to the sleeve 1, the step portion 3*a* of the bead member 3 is pressed toward the front end side in the axial direction via the brush holding portion 11 and abuts on the protruding portions 1*d* of the sleeve 1, so that the bead member is attached so as to be immovable in the axial direction. Therefore, the brush holding portion 11 is sandwiched between a front end surface of the bellows member 5 and a rear end surface of the bead member 3, and is immovable in the axial direction.

In this state, the brush 2 is stored in the through hole 3*b* of the bead member 3, and in the rear portion (rear end), as illustrated in FIGS. 2 and 11, the brush 2 is in contact with the convex portion 3*d* of the corrugated shape 3*c* and is suitably tightened, as illustrated in FIG. 11, the brush 2 is pressed by the convex portion 3*d* of the corrugated shape 3*c* and moved to the concave portions 3*e* on both sides of the convex portions 3*d* so as to be continuously arranged, and a relatively large gap S1 is formed between the arranged brush 2 and the concave portion 3*e* (also see FIG. 3). The gap S1 serves as a liquid cosmetic material accumulation portion capable of sufficiently storing the liquid cosmetic L by a capillary force. The gap S1 extends to a front portion of the bead member 3.

As illustrated in FIG. 7, at the predetermined distance rearward position 3*f* away from the front end of the through hole 3*b* of the bead member 3, as illustrated in FIGS. 2 and 12, the brush 2 is in contact with the sides 3*g* of the octagon and is appropriately pressed. As illustrated in FIG. 12, since the corners of the octagon are each rounded at the portion R, a minute gap S2 communicating with the gap S1 and smaller than the gap S1 is formed between the portion R and the brush 2 (also see FIG. 3). The minute gap S2 is an allowable space where the brush 2 is movable. As illustrated in FIGS. 2 and 3, since the brush 2 is tapered toward the front end, the brush 2 comes into contact with the sides 3*g* and then comes out of contact with the sides 3*g* toward the front side, and the gap between the through hole 3*b* of the bead member 3 and the brush 2 gradually increases.

Figure 6:
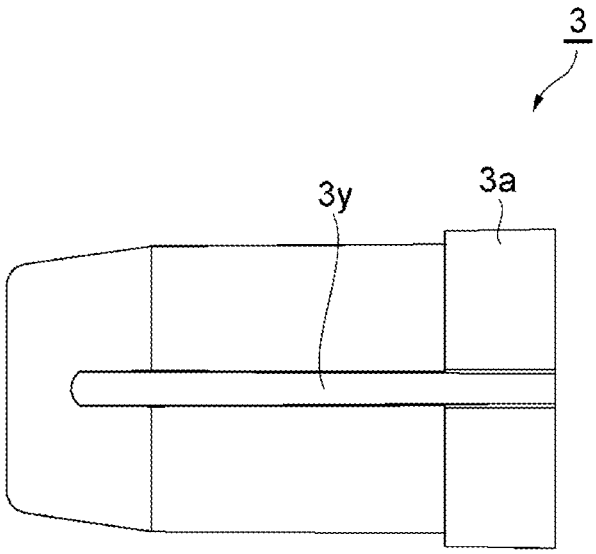
FIG. 6 is a plan view of the bead member illustrated in FIG. 5.

In this state, as illustrated in FIG. 1, the groove 3*y* on the outer peripheral surface of the bead member 3 is an air flow groove that communicates the inside and the outside of the sleeve 1 (see FIGS. 2, 5, and 6).

Further, in this state, as illustrated in FIG. 4, a gap S3 continuous in the circumferential direction is formed between the rear end surface of the bead member 3 and the undulating front end surface 11*a* of the brush holding portion 11 facing the rear end surface, and a degree of communication between the outside and the gap S1 (see FIGS. 3 and 11) via the air flow groove 3*y* (see FIGS. 1 and 2) is further increased by the gap S3.

In this state, as illustrated in FIG. 3, the opening 4*b* at the front end of the relay core 4 is located inward of the rounded corners at the portion R of the octagon in the through hole 3*b* of the bead member 3 (located inward of the position 3*f* illustrated in FIG. 7).

According to the liquid cosmetic material container 100, in the rear portion of the through hole 3*b* of the bead member 3, as illustrated in FIG. 11, the brush 2 is in contact with the convex portions 3*d* of the corrugated shape 3*c* and is suitably tightened, and the brush 2 is pressed by the convex portions 3*d* of the corrugated shape 3*c* and moves to the concave portions 3*e* on both sides of each convex portion 3*d* so as to be continuously arranged, and the gap S1 that becomes the liquid cosmetic material accumulation portion is formed between the arranged brush 2 and the concave portions 3*e*.

At the predetermined distance rearward position 3*f* away from the front end of the through hole 3*b* of the bead member 3, as illustrated in FIG. 12, the portion corresponding to the convex portion 3*d* of the corrugated shape 3*c* is the line (a side of the octagon) 3*g* having the curvature of 0 smaller than the curvature of the convex portion 3*d* of the corrugated shape 3*c*, and the brush 2 is in contact with this portion and is appropriately pressed. The portion corresponding to the concave portion 3*e* of the corrugated shape 3*c* is rounded at the portion R having the curvature smaller than the curvature of the concave 3*e* of the corrugated shape 3*c*, and the minute gap S2 smaller than the gap S1 is formed between the portion R and the brush 2 as the allowable space where the brush 2 is movable, so that the brush 2 is appropriately and easily moved, and the portion R prevents the bristles on the brush 2 from getting caught. That is, at the time of drawing, the brush 2 may be moved in the minute gap S2 while being appropriately pressed by the sides 3*g* of the octagon. A variation of the front end of the brush generated when the brush 2 is pressed without a gap, a disturbance due to excessive blurring of the brush generated when the gap is excessively large, and the catching of the brush 2 by protrusions or the like may be prevented, so that favorable drawing can be performed.

Further, as illustrated in FIG. 3, since the minute gap S2 between the bead member 3 and the brush 2 and the gap S1 are communicated with each other to form an air circulation gap, the liquid cosmetic material L in the liquid cosmetic material accumulation portion can be efficiently supplied to the brush 2.

Further, as illustrated in FIGS. 9 and 10, the brush holding portion 11 that holds the brush 2 and has a diameter larger than that of the base end portion of the brush 2 is provided in the base end portion of the brush 2. As illustrated in FIG. 4, the relay core 4 penetrates the brush holding portion 11, the rear end surface of the bead member 3 that stores the brush 2 faces the front end surface 11*a* of the brush holding portion 11, the front end surface 11*a* of the brush holding portion 11 undulates so as to be uneven in the axial direction, a gap S3 that is continuous in the circumferential direction is formed between the rear end surface of the facing bead member 3 and the undulating front end surface 11*a* of the brush holding portion 11, and the degree of communication between the outside and the gap S1 is further increased by the gap S3, so that the liquid cosmetic material can be more efficiently supplied to the brush 2.

Further, as illustrated in FIGS. 2, 3, 11, and 12, since the relay core 4 is formed of a plastic material having the cavities 4*a* penetrating in the axial direction, the liquid cosmetic material L using a material having a large particle diameter such as a pearl agent or the liquid cosmetic material L having high viscosity can be suitably supplied to the brush 2 through the cavities 4*a* by the capillary force.

Further, as illustrated in FIG. 3, since the opening 4*b* at the front end of the relay core 4 is located inward of the portion R having a curvature smaller than the curvature of the concave portion 3*e* of the corrugated shape 3*c* in the through hole 3*b* of the bead member 3, the brush 2 moves (flutters) in the minute gap S2 and hits the opening 4*b* at the front end of the relay core 4 formed of a plastic material at the time of drawing. Thereby, a contact range of the brush 2 with the opening 4*b* at the front end of the relay core 4 is expanded, an outflow of the liquid cosmetic material L from the opening 4*b* at the front end of the relay core 4 is promoted, the liquid cosmetic material L is easily transmitted to the brush 2, and beautiful drawing can be performed.

Although the present disclosure has been specifically described above based on the embodiment, the present disclosure is not limited to the above embodiment, and for example, in the above embodiment, the number of cavities 4*a* of the relay core 4 is particularly preferably two, and the number of cavities 4*a* are preferable plural but may be one.

Further, in the above embodiment, a shape of each corner of the octagon of the through hole 3*b* of the bead member 3 rounded at the portion R is particularly preferably formed from the front end of the through hole 3*b* of the bead member 3 to the predetermined distance rearward position 3*f*, but the shape may be formed only at the front end of the through hole 3*b* that is reduced in diameter from the rear end to the front end of the bead member 3, and the brush 2 may be brought into contact with the sides 3*g* of the octagon of the front end surface.

In the above embodiment, the shape of the front portion 3*x* of the through hole 3*b* of the bead member 3 as viewed in the axial direction is a shape in which the corners of the octagon are rounded at the portion R, but may be a polygonal shape other than the octagon. Further, the side 3*g* of the polygonal shape of the front portion 3*x* of the through hole 3*b* of the bead member 3 as viewed in the axial direction may be a line having a curvature smaller than the curvature of the convex portion 3*d* of the corrugated shape 3*c*. Of course, the corners of the polygonal shape may not be rounded and the polygonal shape may be a simple polygonal shape.

Further, in the above embodiment, a so-called direct liquid type is adopted in which the liquid cosmetic L is directly stored in the storage chamber 1*a* and supplied to the brush 2 via the relay core 4 while a liquid amount of the liquid cosmetic material L is adjusted by the bellows member 5, but the present disclosure is also applicable to a so-called cotton type in which the bellows member 5 is not provided, and a cotton pad (impregnated body) impregnated with the liquid cosmetic material L is stored in the storage chamber and the liquid cosmetic material L of the cotton pad is supplied to the brush 2 via the relay core 4.

Further, in the above embodiment, although the relay core 4 is formed of a plastic material having the cavities 4*a* penetrating in the axial direction, for example, as often used in the related art, the relay core 4 may be formed as a relay core obtained by hardening a resin such as thermoplastic elastomer (TPE)) with an adhesive resin, polishing an outer peripheral surface, a rear end surface, and a front end surface of a hardened fiber bundle into a shape similar to the shape of the above embodiment, and exhibiting a capillary phenomenon through fibers. In this case, the liquid cosmetic material L also permeates into the brush 2 from an outer peripheral surface of the relay core 4 and comes out.

Further, in the above embodiment, the cavities 4*a* penetrating in the axial direction are provided inside the relay core 4 formed of the plastic material, but the relay core may be formed in a way of having a groove that extends in the axial direction and has a front end and a rear end opened to the outside on an outer periphery thereof.

Further, in the above embodiment, an outer shape of the sleeve or the like is particularly preferably a circular shape, but various shapes including a circular shape, a rectangular shape, a flat shape, and an elliptical shape may be appropriately adopted.

What is claimed is:

1. A liquid cosmetic material container comprising:

a sleeve that includes a storage chamber that stores a liquid cosmetic material therein;

a bead member that is disposed at a front end of the sleeve, has a through hole extending in an axial direction of the liquid cosmetic material container and configured to store a brush in the through hole;

a relay core that is configured to connect the brush and the storage chamber, enter the brush, and send the liquid cosmetic material in the storage chamber to the brush; and a cap that is detachably attached to the sleeve, wherein a rear portion of the through hole has a first cross sectional area, a front portion of the through hole has a second cross sectional area which is smaller than the first cross sectional area, and a cross sectional area of the through hole is gradually changed from the first cross sectional area to the second cross sectional area, when viewed in the axial direction, a shape of the rear portion of the through hole is formed in a first corrugated shape in which first concave and first convex portions are alternately disposed and connected to have a first annular shape, the brush comes into contact with the first convex portions of the first corrugated shape, and a first gap is formed between each of the first concave portions of the first corrugated shape and the brush, when viewed in the axial direction, a shape of the front portion of the through hole is formed in a second corrugated shape in which second concave and second convex portions are alternately disposed and connected to have a second annular shape, the brush comes into contact with the second convex portions of the second corrugated shape, and a second gap which is smaller than the first gap is formed between each of the second concave portions of the second corrugated shape and the brush, a concave curvature of one of the second concave portions is smaller than that of a corresponding one of the first concave portions, and a convex curvature of one of the second convex portions is smaller than that of a corresponding one of the first convex portions.

2. The liquid cosmetic material container according to claim 1, wherein the convex curvature of the one of the second convex portions is 0 so that the second corrugated shape includes straight lines, and the second corrugated shape is a shape in which a corner of a polygon including the straight lines is rounded to the concave curvature.

3. The liquid cosmetic material container according to claim 1 further comprising a brush holding portion that holds the brush and has a diameter larger than a diameter of a base end portion of the brush, and is disposed at the base end portion of the brush, wherein the relay core penetrates the brush holding portion, a rear end surface of the bead member faces a front end surface of the brush holding portion, and the front end surface of the brush holding portion undulates so as to be uneven in the axial direction.

4. The liquid cosmetic material container according to claim 1, wherein the relay core is formed of a plastic material having a cavity that penetrates in the axial direction at an inside thereof.

5. The liquid cosmetic material container according to claim 4, wherein the relay core has an opening at a front end of the relay core, and the opening is disposed at an inner side of the second concave portions and the second convex portions in a radial direction of the liquid cosmetic material container.

6. A bead member for holding a brush for a liquid cosmetic material comprising:

a cylindrical wall in which a through hole extending in an axial direction of the cylindrical wall is formed;

wherein a rear portion of the through hole has a first cross sectional area, a front portion of the through hole has a second cross sectional area which is smaller than the first cross sectional area, and a cross sectional area of the through hole is gradually changed from the first cross sectional area to the second cross sectional area, when viewed in the axial direction, a shape of the rear portion of the through hole is formed in a first corrugated shape in which first concave and first convex portions are alternately disposed and connected to have a first annular shape, the brush comes into contact with the first convex portions of the first corrugated shape, and a first gap is formed between each of the first concave portions of the first corrugated shape and the brush, when viewed in the axial direction, a shape of the front portion of the through hole is formed in a second corrugated shape in which second concave and second convex portions are alternately disposed and connected to have a second annular shape, the brush comes into contact with the second convex portions of the second corrugated shape, and a second gap which is smaller than the first gap is formed between each of the second concave portions of the second corrugated shape and the brush, a concave curvature of one of the second concave portions is smaller than that of a corresponding one of the first concave portions, and a convex curvature of one of the second convex portions is smaller than that of a corresponding one of the first convex portions.

7. A liquid cosmetic material container comprising:

a sleeve that includes a storage chamber that stores a liquid cosmetic material therein;

a bead member that is disposed at a front end of the sleeve, has a through hole extending in an axial direction of the liquid cosmetic material container and configured to store a brush in the through hole; and a relay core that is configured to connect the brush and the storage chamber, enter the brush, and send the liquid cosmetic material in the storage chamber to the brush, wherein a rear portion of the through hole has a first cross sectional area, a front portion of the through hole has a second cross sectional area which is smaller than the first cross sectional area, and a cross sectional area of the through hole is gradually changed from the first cross sectional area to the second cross sectional area, when viewed in the axial direction, a shape of the rear portion of the through hole is formed in a first polygonal shape including first sides and first vertexes, the brush comes into contact with the first sides of the first polygonal shape, and a first gap is formed between each of the first vertex of the first polygonal shape and an outer face of the brush, and when viewed in the axial direction, a shape of the front portion of the through hole is formed in a second polygonal shape including second sides and second vertexes, the brush comes into contact with the second sides of the second polygonal shape, and a second gap which is smaller than the first gap is formed between each of the second vertex of the second polygonal shape and the outer face of the brush.

8. The liquid cosmetic material container according to claim 7, wherein the first polygonal shape is octagon.

9. The liquid cosmetic material container according to claim 7, wherein the second polygonal shape is octagon.

10. A liquid cosmetic material container comprising:

a sleeve that includes a storage chamber that stores a liquid cosmetic material therein;

a bead member that is disposed at a front end of the sleeve, has a through hole extending in an axial direction of the liquid cosmetic material container and configured to store a brush in the through hole; and a relay core that is configured to connect the brush and the storage chamber, enter the brush, and send the liquid cosmetic material in the storage chamber to the brush, wherein a rear portion of the through hole has a first cross sectional area, a front portion of the through hole has a second cross sectional area which is smaller than the first cross sectional area, and a cross sectional area of the through hole is gradually changed from the first cross sectional area to the second cross sectional area, when viewed in the axial direction, a shape of the rear portion of the through hole is formed in a first corrugated shape including first concave portions and first convex portions that are alternately disposed and connected to have a first annular shape, the brush comes into contact with the first convex portions of the first corrugated shape, and a first gap is formed between each of the first concave portions of the first corrugated shape and an outer face of the brush, when viewed in the axial direction, a shape of the front portion of the through hole is formed in a second corrugated shape including second concave portions and second convex portions that are alternately disposed and connected to have second annular shape, wherein the second annular shape is a polygonal shape in which the second convex portions are sides of the polygonal shape and the second concave portions are vertexes of the polygonal shape, and wherein the brush comes into contact with the second convex portions of the second corrugated shape, and a second gap which is smaller than the first gap is formed between each of the second concave portions of the second corrugated shape and the outer face of the brush, a concave curvature of one of the second concave portions is smaller than that of a corresponding one of the first concave portions, and a convex curvature of one of the second convex portions is smaller than that of a corresponding one of the first convex portions.

11. The liquid cosmetic material container according to claim 10, wherein the polygonal shape is octagon.

* * * * *